United States Patent [19]

Eskam et al.

[11] Patent Number: 4,957,035

[45] Date of Patent: Sep. 18, 1990

[54] ELECTROTHERMAL ACCELERATION DEVICE

[75] Inventors: Armin Eskam, Langenfeld; Günter Frye, Erkrath; Herbert Krumm, Kaarst, all of Fed. Rep. of Germany

[73] Assignee: Rheinmetall GmbH, Düsseldorf, Fed. Rep. of Germany

[21] Appl. No.: 337,047

[22] Filed: Apr. 12, 1989

[30] Foreign Application Priority Data

Apr. 28, 1988 [DE] Fed. Rep. of Germany ..... 3814330

[51] Int. Cl.[5] ..... F41B 6/00

[52] U.S. Cl. ..... 89/8

[58] Field of Search ..... 89/8

[56] References Cited

U.S. PATENT DOCUMENTS

| | | | |
|---|---|---|---|
| 667,435 | 2/1901 | Friese-Green et al. | 89/28.05 |
| 3,267,720 | 8/1966 | Escallier et al. | 73/12 |
| 4,590,842 | 5/1986 | Goldstein et al. | 89/8 |
| 4,625,618 | 12/1986 | Howanick | 89/8 |
| 4,715,261 | 12/1987 | Goldstein et al. | 89/8 |

FOREIGN PATENT DOCUMENTS 3613259 10/1987 Fed. Rep. of Germany .

*Primary Examiner*—Stephen C. Bentley
*Attorney, Agent, or Firm*—Spencer & Frank

[57] ABSTRACT

An electrothermal acceleration device, having a housing with a breechblock at one end, wherein a plasma burner disposed at the breechblock includes a plurality of plasma channels which are arranged so as to be electrically insulated from one another and from the housing. Preferably, the plasma burner has a conical shape so as to realize good gas tightness.

12 Claims, 5 Drawing Sheets

ELECTROTHERMAL ACCELERATION DEVICE

BACKGROUND OF THE INVENTION

The present invention relates to an electrothermal acceleration device of a weapon which accelerates projectiles from a launching tube with a plasma heated with a pair of electrodes at a breech and breechblock of the launching tube.

In prior electrothermal acceleration devices of this type, a conversion of electromagnetic energy to thermal energy is utilized in that a hot plasma for driving the projectile is produced and heated by means of an electric arc burning between fixed electrodes (see, for example, Federal Republic of Germany patent publication no. DE-A 3,613,259). The fixed electrodes are arranged at the breechblock of a lauching tube and form a plasma burner. The two electrodes are insulated from one another by separating a front portion of a housing from a rear portion with components made of non-conductive materials. In this region in particular, special measures must be taken to realize a sufficiently tight electrical and mechanical seal. In spite of a low energy of less than 250 kJ, it is sufficient to destroy components in the region by erosion, burning and chemical reactions. Moreover, in order to remove the damage, including repair of the plasma burner, and to load the launching tube, it is necessary to almost completely disassemble the acceleration device.

SUMMARY OF THE INVENTION

It is therefore an object of the invention to provide a device of the above-mentioned type which is of simple construction and exhibits the necessary gas tightness, electrical insulation and burn resistance for components subject to high stresses, as well as high efficiency.

This is accomplished with an electrothermal acceleration device for accelerating projectiles which includes a replaceable plasma burner disposed in a housing at a breechblock, for producing an electric ar between fixed electrodes thereof to generate and heat the plasma, wherein the plasma burner includes at least two plasma channels which are electrically insulated from one another and the housing.

Thus, the invention is essentially based on the fact that the plasma burner is provided with a plurality of plasma channels and is of a compact construction. The good gas tightness results, in particular, from the conical shape of the plasma burner.

BRIEF DESCRIPTION OF THE DRAWINGS

These and further details and advantages of the invention can be more completely understood from the following detailed description of the preferred embodiments with reference to the accompanying drawings in which.

DESCRIPTION OF THE PREFERRED EMBODIMENTS

Figure 1:
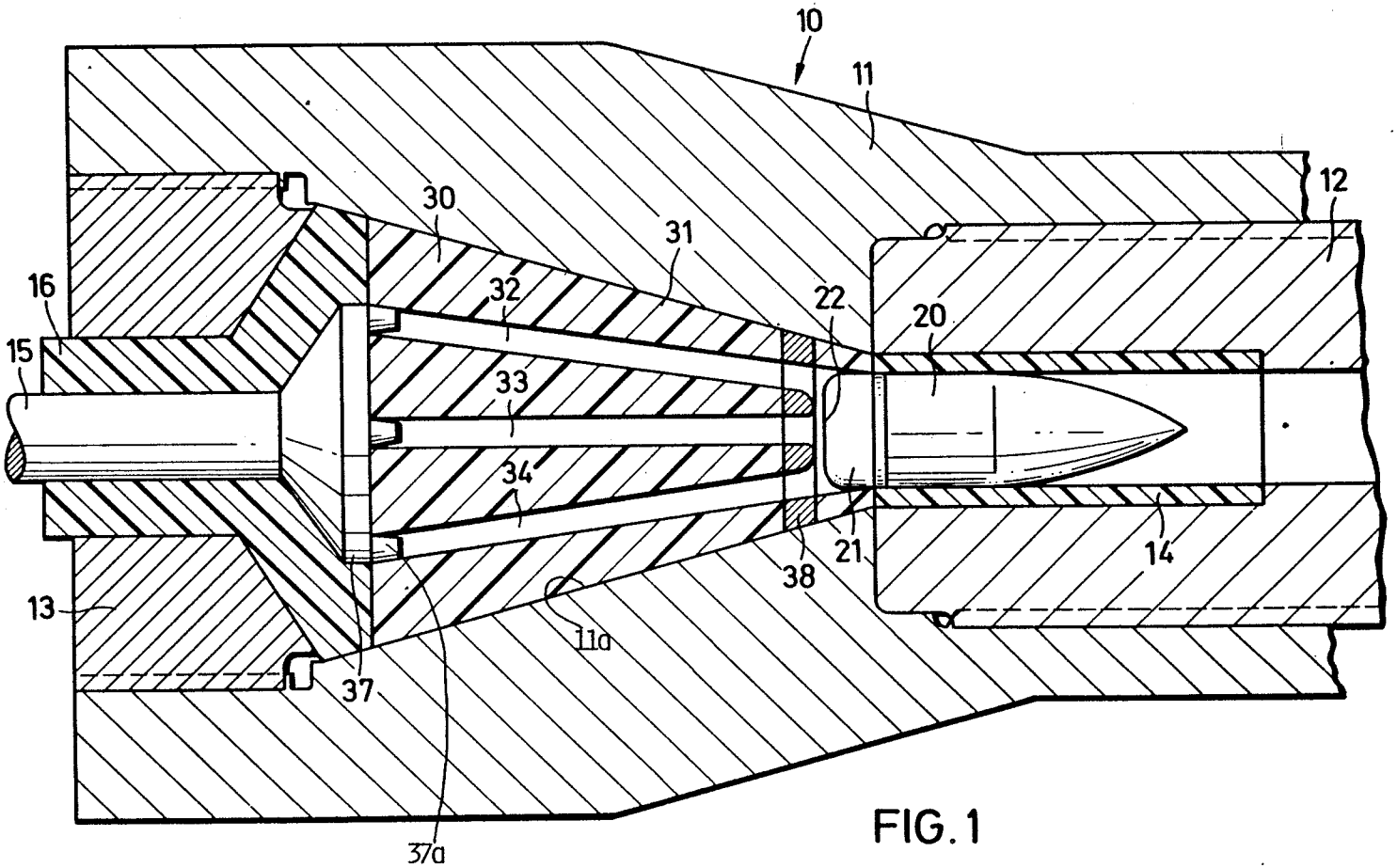
FIG. 1 is a cross-sectional view of a breechblock end of an electrothermal acceleration device according to the invention.
Figure 2:
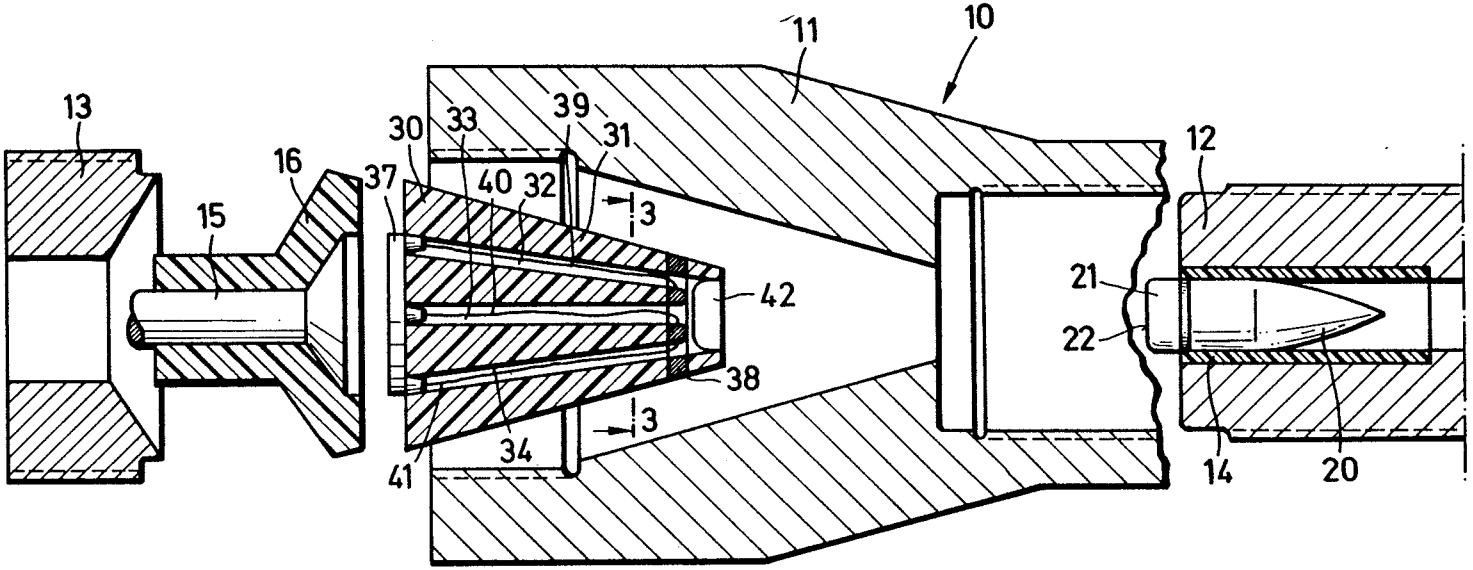
FIG. 2 is an exploded cross-sectional view of the parts shown in FIG. 1.

In FIGS. 1 and 2, the breechblock end of an electrothermal acceleration device is designated by reference numeral 10, a projectile to be accelerated is designated by reference numeral 20 and a plasma burner according to the invention is designated by reference numeral 30.

The acceleration device 10 is essentially composed of a housing 11, a launching tube 12 to be screwed into the housing and a screw-type breechblock 13. Advantageously, a preferably wear away, insulating sleeve 14 is disposed in tube 12 to prevent the plasma from uncontrollably propagating in the tube.

Figure 3:
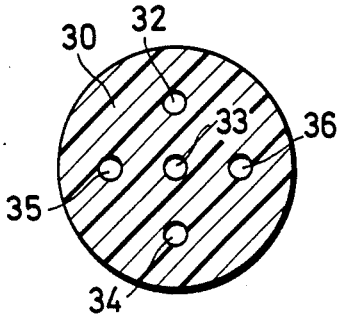
FIG. 3 is a sectional view of the plasma burner along line A—A of FIG. 2.
Figure 4:
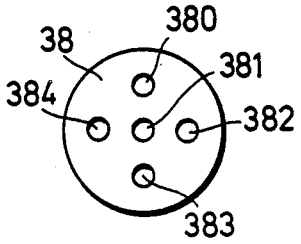
FIG. 4 is a top view of an electrode disc provided with bores.

Plasma burner 30 is essentially composed of an insulating element 31 having plasma channels 32 to 36 (see also FIG. 3), and electrodes 37 and 38. Electrode 37 is a metal disc which is provided with web-like pins 37*a* extending into plasma channels 32 to 36. Electrode 38 faces the base 22 of the rear portion 21 of the projectile 20 and is provided with bores 380–384 so that ring electrodes are formed with reference to the plasma channels 32 to 36.

Plasma burner 30 has a mouth 42 forward of the electrode 37 (see also FIG. 2) which receives the projectile rear portion 21, and has a conical configuration of such a shape that it electrically insulates the individual plasma channels from one another and from the housing 11.

Behind plasma burner 30 is a terminal 15 for one pole of an electrical supply (not shown), which is electrically insulated from housing 11 and also from breechblock 13, by means of an insulating body 16.

By way of its conical seat, breechblock 13 presses plasma burner 30, terminal 15 and insulating body 16 into a conical seat 11*a* of housing 11 Preferably, breechblock 13 puts plasma burner 30 under a high internal pressure stress between housing 11 and breechblock 13 to thus favorably counteract the plasma pressure. The high internal pressure stresses generated by the breechblock provide a good seal against leakage of the plasma in the conical regions 11*a* of housing 11 and breechblock 13. Housing 11 constitutes the second pole of the electrical supply.

High strength tubular steels (e.g. 35 NiCrMo 12.5) can be employed as materials for the external region including housing 11, tube 12 and breechblock 13. In the insulated internal regions including plasma burner 30, insulating sleeve 14 and insulating body 16, plastics, ceramics and composite substances (plastic/ceramic matrix) should be used. In other embodiments such as are described below the plasma burner 30 may also be formed of a composite material of ceramic bodies, plastics and steel elements.

The arc for generating and heating the plasma is preferably fired with the use of metal wires 39, 40, 41 (shown only in FIG. 2) disposed between electrodes 37 and 38 in plasma channels 32 to 36; due to a strong current, these wires evaporate. The arc burning between electrodes 37 and 38 then further heats the existing plasma and in some embodiments, causes a filler material to evaporate (see, for example, FIG. 7). The insulating material of the plasma burner will generally also evaporate. Instead of a wire, the arc may alternatively be fired by an electrically conductive sheet, an internal coating on the plasma channels 32–36 as are described below in connection with the embodiments illustrated in FIGS. 6–8, or by the filler material itself.

The actual operation of the electrothermal acceleration device is known per se (see the above-cited patent publication no. DE-A-3,613,259) and need not be described in detail here.

Figure 5A:
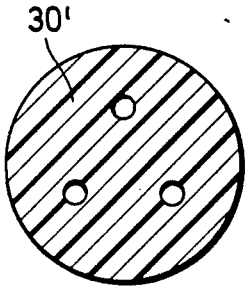
FIGS. 5*a*, 5*b* and 5*c* are sectional views of various further embodiments of the plasma burner.
Figure 5B:
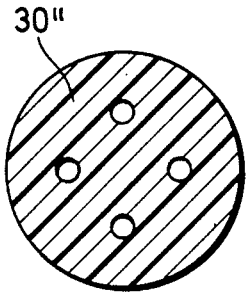
Figure 5C:
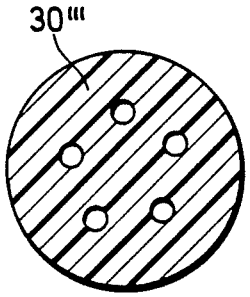

FIGS. 5a, 5b and 5c are cross-sectional views of further embodiments of plasma burners 3', 30'' and 30'''. These plasma burners have respectively three, four and five plasma channels. The number, arrangement and dimensions of the plasma channels should be optimized in such a manner that the available electrical energy is efficiently converted to projectile energy.

Figure 6:
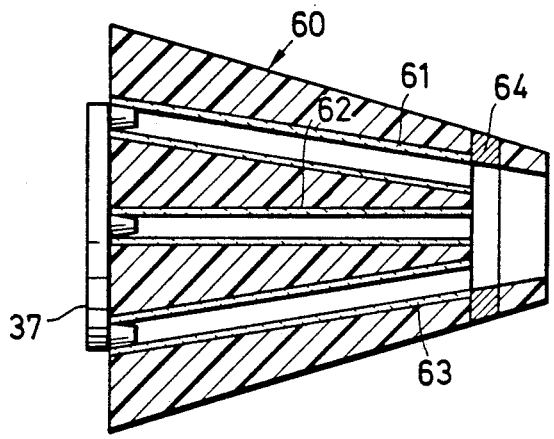
FIGS. 6, 7 and 8 are cross-sectional views of still further embodiments of the plasma burner.

FIG. 6 shows a plasma burner 60 in which the walls of the plasma channels are formed by ceramic bodies 61, 62 and 63. In this case, the front electrode 64 is ring shaped so that the entire bundle of plasma channels open into its center opening, thus making it possible to give the combustion chamber a favorable configuration. Lining the plasma channels with the ceramic bodies has the advantage that better service life is realized primarily with respect to the high plasma temperature.

Figure 7:
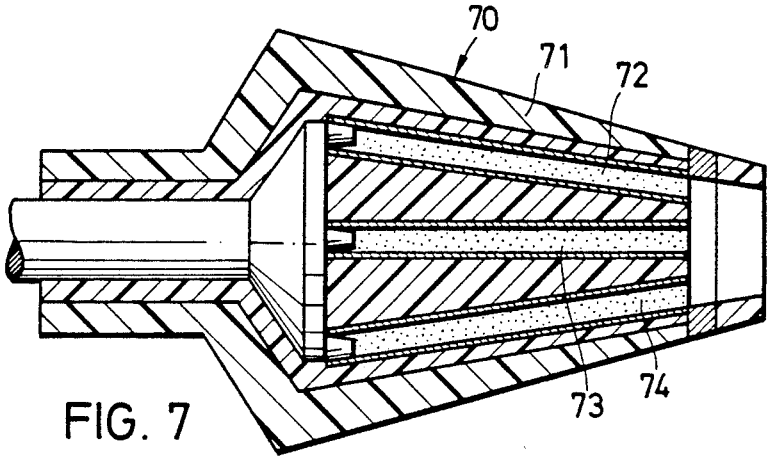

FIG. 7 shows a plasma burner 70 in which an outer sheath 71 is formed by a wound layer of fiberglass-reinforced plastic (FRP). With such an arrangement, a better resistance to the plasma pressure is realized. Additionally, an electrically conductive substance is employed as the filler material 72, 73, 74 which permits the plasma to be generated, and increases the plasma pressure by its reaction.

Figure 8:
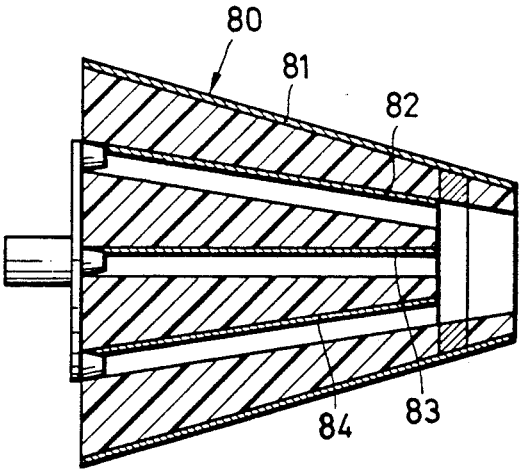

In FIG. 8, the outer sheath 81 of plasma burner 80 is composed of a metal layer which is worked to very precise dimensions. Thus a well sealed surface is obtained. Moreover, instead of a wire to fire the arc, the plasma channels are given respective conductive interior coatings 82, 83, 84 or are covered by respective electrically conductive sheets. This results in the advantage that the plasma is better able to propagate and, primarily in conjunction with an electrically conductive substance present in the channels, takes care that there is a high plasma pressure level.

Figure 9:
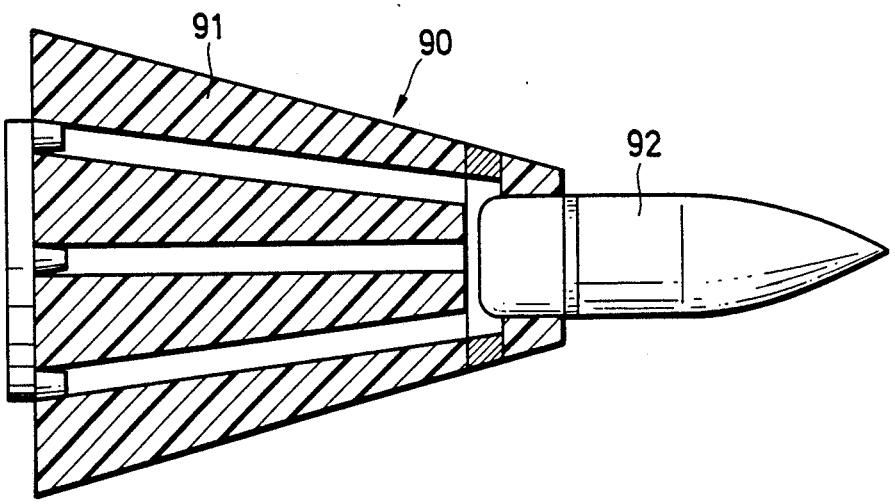
FIG. 9 is a cross-sectional view of an ammunition unit composed of a projectile and a plasma burner.

It may be of particular advantage for the plasma burner and projectile to form a unit. This substantially facilitates manipulation for loading. A corresponding embodiment is shown in FIG. 9 in which the total ammunition unit is designated by reference numeral 90, the plasma burner is designated by reference numeral 91 and the projectile removably mounted in the front end of the plasma burner is designated by reference numeral 92.

The present disclosure relates to the subject matter disclosed in Federal Republic of Germany patent publication no. P 38 14 330.5 of Apr. 28th, 1988, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. An electrothermal acceleration device for accelerating projectiles, comprising:

a housing having a breechblock at one end, an open end opposite said one end and a space between said one end and said open end; and a plasma burner/projectile unit removably disposed in said housing, including a projectile to be accelerated, said projectile being disposed in said space, and a plasma burner at said one end, said plasma burner having at least two plasma channels formed therein;

said plasma burner including first and second spaced apart electrodes, means for electrically insulating said at least two plasma channels from each other and from said housing, said at least two plasma channels extending from said first electrode to said second electrode, said first electrode being disc shaped, being fixed at a frontal portion of said plasma burner, and having passage means therein through which said at least two plasma channels communicate with said space, and means for generating an electric arc extending through said at least two plasma channels from said first electrode to said second electrode to produce and heat a plasma in said at least two plasma channels which accelerates the projectile from said space toward said open end of said housing;

said projectile being removably mounted to a front end of said plasma burner, wherein said passage means comprises bores in said disk-shaped electrode respectively aligned with said at least two plasma channels so that the inner peripheral surfaces of the bores define ring electrodes corresponding to the respective plasma channels, said at least two plasma channels communicating with said space through the respective aligned bores.

2. An electrothermal acceleration device for accelerating projectiles, comprising:

a housing having a breechblock at one end, an open end opposite said one end, and a space between said one end and said open end for receiving a projectile to be accelerated; and a plasma burner removably disposed in said housing at said one end, having at least two plasma channels formed therein and including first and second electrodes, means for electrically insulating said at least two plasma channels from each other and from said housing, said at least two plasma channels extending from said first electrode to said second electrode, said first electrode being disc shaped, being disposed at a frontal portion of said plasma burner, and having bores therein respectively aligned with the plasma channels so that the inner peripheral surfaces of the bores define ring electrodes corresponding to the respective plasma channels and said at least two plasma channels communicate with said space through the respectively aligned bores, and means for generating an electric arc extending through said at least two plasma channels from said first electrode to said second electrode to produce and heat a plasma in said at least two plasma channels which accelerates the projectile from said space toward said open end of said tube.

3. An electrothermal acceleration device as in claim 2, wherein said plasma burner is conically shaped.

4. An electrothermal acceleration device as in claim 3, wherein said housing has a conically shaped second space which removably receives said plasma burner.

5. An electrothermal acceleration device as in claim 2, wherein said plasma burner has a burner mouth facing said first space for receiving a rear section of the projectile, said at least two plasma channels opening into said burner mouth.

6. An electrothermal acceleration device as in claim 5, further comprising an electrically conductive substance filling each of said at least two plasma channels, which substance is responsive to the presence of the plasma to increase the gaseous pressure in said at least two plasma channels and in said burner mouth.

7. An electrothermal acceleration device as in claim 2, wherein said means for generating an electric arc includes means in each of said at least two plasma channels for electrically connecting said first and second electrodes, said electrically connecting means consisting of one of an electrically conductive wire, an electrically conductive interior coating of the channel and an electrically conductive sheet.

8. An electrothermal acceleration device as in claim 2, further comprising an electrically conductive substance filling each of said at least two plasma channels, which substance is responsive to the presence of the plasma to increase the gaseous pressure in said at least two plasma channels.

9. An electrothermal acceleration device as in claim 2, wherein said plasma burner is formed of plastic.

10. An electrothermal acceleration device as in claim 9, wherein said at least two plasma channels have walls formed of ceramic bodies embedded in the plastic of the plasma burner.

11. An electrothermal acceleration device as in claim 2, wherein said plasma burner has an external layer of fiberglass-reinforced plastic.

12. An electrothermal acceleration device as in claim 2, wherein said plasma burner has an external layer of metal.

* * * * *